United States Patent [19]

Teshima et al.

[11] 4,072,005

[45] Feb. 7, 1978

[54] CLOCK DEVICE

[75] Inventors: Toru Teshima, Hatano; Takuhisa Ehara, Tokyo; Kaname Nakanishi, Hatano, all of Japan

[73] Assignee: Stanley Electric Co., Ltd., Japan

[21] Appl. No.: 649,856

[22] Filed: Jan. 16, 1976

[30] Foreign Application Priority Data

June 27, 1975 Japan ..... 50-79791

[51] Int. Cl.[2] ..... G04B 19/22; G04C 3/00

[52] U.S. Cl. ..... 58/42.5; 58/4 A; 58/23 R; 58/50 R

[58] Field of Search ..... 58/4 A, 23 R, 42.5, 58/43, 50 R, 152 G

[56] References Cited

U.S. PATENT DOCUMENTS

| | | | |
|---|---|---|---|
| 3,653,204 | 4/1972 | Miwa | 58/42.5 |
| 3,852,950 | 12/1974 | Yoda et al. | 58/4 A |
| 3,940,920 | 3/1976 | Nakamura et al. | 58/42.5 |

FOREIGN PATENT DOCUMENTS

| | | | |
|---|---|---|---|
| 2,412,613 | 10/1974 | Germany | 58/42.5 |

*Primary Examiner*—Stanley J. Witkowski

*Attorney, Agent, or Firm*—Weingarten, Maxham & Schurgin

[57] ABSTRACT

A clock device comprising a clock signal oscillator, a time zone selection circuit for detecting a selected point when performing an operation for selecting a time zone, a reference time zone circuit for determining a reference time zone, a detector circuit for detecting the beginning of the operation for selecting a time zone, a timer circuit adapted to operate when receiving an output from the detector circuit, a time difference signal circuit for generating a desired time difference signal by receiving signals from the time zone selection circuit, the reference time zone circuit and the timer circuit, an adder circuit for adding output signals from the clock signal oscillator and the time difference signal circuit, a decoder for decoding an output of the adder circuit, and a display circuit for displaying the time at the selected point and adapted to operate by receiving an output of the decoder.

4 Claims, 3 Drawing Figures

CLOCK DEVICE

BRIEF SUMMARY OF THE INVENTION

The present invention relates to a clock device and more particularly to a clock device which is constructed to be capable of knowing time of each country in the world.

It is an object of the invention to provide a clock device which can display the time of each country in the world in a simple manner.

It is another object of the invention to provide a clock device comprising means for supplying position data based on a fiducial line on the longitude, clock circuit means for supplying time data, and means for effecting a duo-decimal addition of the time and position data so as to correct for differences in time.

It is a further object of the invention to provide a clock device which comprises a clock signal oscillator, a time zone selection circuit for detecting a selected point when performing an operation for selecting a time zone, a reference time zone circuit for determining a reference time zone, a detector circuit for detecting the beginning of the operation for selecting a time zone, a timer circuit adapted to operate when receiving an output from the detector circuit, a time difference signal circuit for generating a desired time difference signal by receiving signals from the time zone selection circuit, the reference time zone circuit and the timer circuit, an adder circuit for adding output signals from the clock signal oscillator and time difference signal circuit, a decoder for decoding output of the adder circuit, and a display circuit for displaying the time at the selected point and adapted to operate by receiving an output of the decoder.

It is a still further object of the invention to provide a clock device in which a reference time zone may be simply changed by providing programming switches to determine a desired region.

The above and further objects and novel features of the invention will more fully appear from the following detailed description when the same is read in connection with the accompanying drawing. It is to be expressly understood, however, that the drawings are for purpose of illustration only and are not intended as a definition of the limits of the invention.

DETAILED DESCRIPTION OF THE INVENTION

Figure 1:
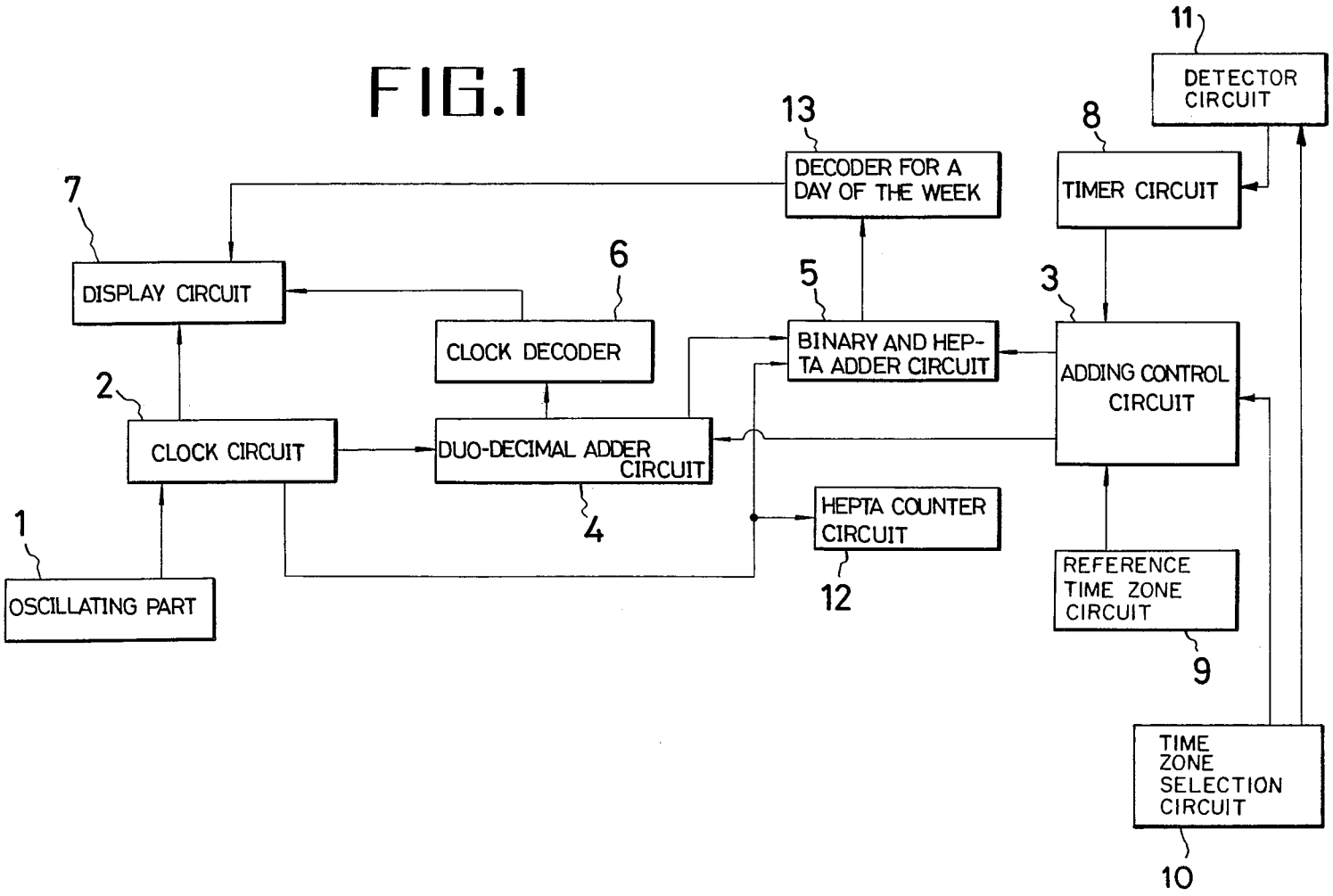
FIG. 1 is a block diagram showing a clock device according to the invention.

Referring now to FIG. 1 which is intended to explain the rough structure of a clock device according to the invention and which, therefore, does not show the detailed wiring between structural elements, the clock device comprises an oscillating part 1 for providing an oscillation produced from a crystal oscillator 200 after frequency dividing to 50 Hz in a frequency divider circuit, a clock circuit 2 for counting the output of the oscillating part 1, the clock circuit including frequency dividers with a desired ratio of frequency division, an adding control circuit 3, a duo-decimal adder circuit 4 for adding time informations from the clock circuit 2 and time difference signals (position information), a binary and hepta adder circuit 5, a clock decoder 6, a display circuit 7, a timer circuit 8, a reference time zone circuit 9 for determining a reference region, a time zone selection circuit 10 for selecting a time zone, a detector circuit 11 for detecting the beginning of operation of the time zone selection circuit 10, a hepta counter circuit 12, and a decoder 13 for the day of the week.

Figure 2:
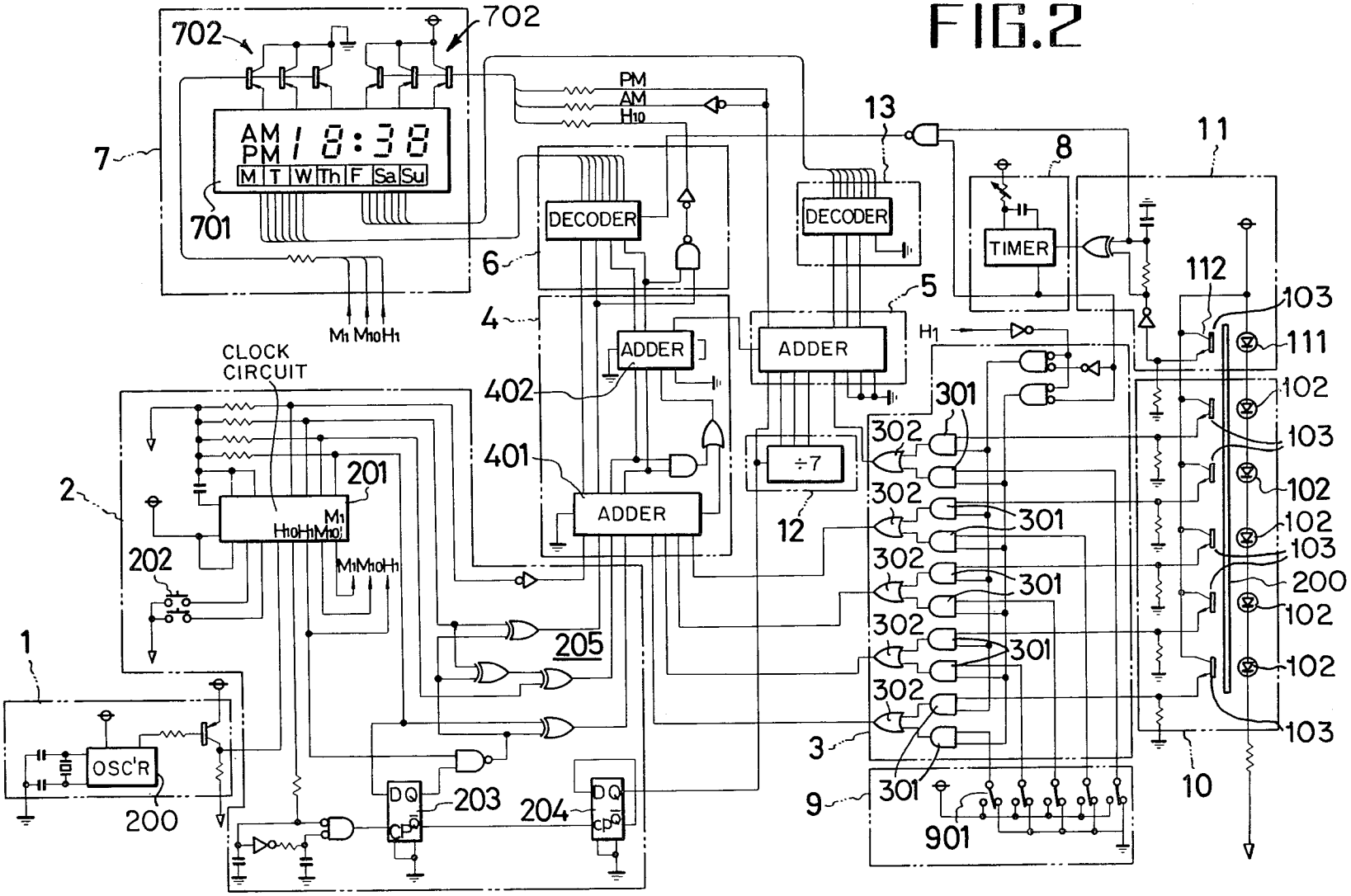
FIG. 2 is a circuit diagram showing in detail the device in FIG. 1.
Figure 3:
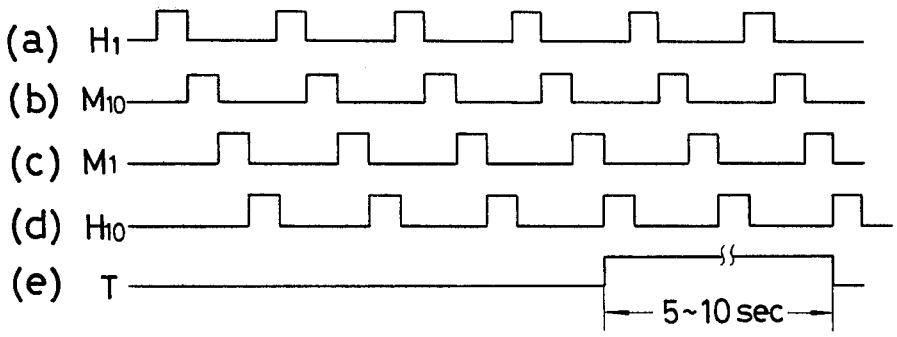
FIG. 3 is a time chart for explaining operation of the device shown in FIG. 2.

Each of circuit elements will be described in detail with reference to FIGS. 2 and 3. The clock circuit 2 is provided with integrated circuit (IC) 201 which includes frequency dividers of 50, 10, 6, 12 and 2, and multiplexers for providing time multiplexed data produced by the frequency dividers. The outputs of the integrated circuits are fed to the duo-decimal adder circuit 4 through code converter circuits 205 for converting the outputs into codes to fit to the duo-decimal addition. The integrated circuits, further, generate timing pulses $H_1$, $M_1$, $M_{10}$ and $H_{10}$ as shown in FIGS. 3(a-)-(d) and the pulses $H_1$, $M_1$ and $M_{10}$ are fed to the display circuit 7 in order to control drive transistors 702. The pulses $H_1$ and $H_{10}$ are applied to D-type flip-flops 203 and 204 together with a portion of the time data so as to produce a signal for discriminating AM-PM (ante meridiem - post meridiem), the signal being applied to the binary and hepta adder circuit 5 and to the hepta counter circuit 12.

The adding control circuit 3 has a group of AND gates 301 and OR gates 302 which use as gate control signals the output of the timer circuit 8 and the timing pulse $H_1$ and whch receive outputs from the time zone selection circuit 10 and of the reference time zone circuit 9. AND gates 301 and OR gates 302 select which of the signals from time zone selectio circuit 10 and reference time zone circuit 9 are provided as the time difference signals at the outputs of adding control circuit 3, in accordance with the output from timer 8. The time difference signals are applied to the duo-decimal adder circuit 4 and to the binary and hepta adder circuit 5. The outputs of the time zone selection circuit 10 and of the reference time zone circuit 9 provide, position data and are determined in accordance with the longitude as shown in the following table.

| Longitude | Signal | Longitude | Signal |
|---|---|---|---|
| Reference | 0 0 0 0 0 | 180° | 0 0 0 0 1 |
| 15° | 1 0 0 0 0 | 195° | 1 0 0 0 1 |
| 30° | 0 1 0 0 0 | 210° | 0 1 0 0 1 |
| 45° | 1 1 0 0 0 | 225° | 1 1 0 0 1 |
| 60° | 0 0 1 0 0 | 240° | 0 0 1 0 1 |
| 75° | 1 0 1 0 0 | 255° | 1 0 1 0 1 |
| 90° | 0 1 1 0 0 | 270° | 0 1 1 0 1 |
| 105° | 1 1 1 0 0 | 285° | 1 1 1 0 1 |
| 120° | 0 0 0 1 0 | 300° | 0 0 0 1 1 |
| 135° | 1 0 0 1 0 | 315° | 1 0 0 1 1 |
| 150° | 0 1 0 1 0 | 330° | 0 1 0 1 1 |
| 165° | 1 1 0 1 0 | 345° | 1 1 0 1 1 |

The duo-decimal adder circuit 4 has integrated circuits 401 and 402 which perform a duo-decimal addition of the parallel four bit values composing the time data from the clock circuit 2 and the position data or time difference signals, from the adding control circuit 3. The resulting sum is applied to the clock decoder 6 and at the same time a carry signal is applied to the binary adder portion of the binary and hepta adder circuit 5.

The time zone selection circuit 10 detects a position of a fiducial line indicating a time zone. Time zone selection circuit 10 is provided with an optical reader comprising a group 102 of luminescent elements and a group 103 of photo transistors for detecting characters of a code plate 101 which is moved to select a time zone. The detector circuit 11 detects a selection operation and includes an optical reader comprising a luminescent element 111 and a photo transistor 112. Detector circuit 11 detects on code plate 101 upon displacement of the code plate 101 and generates a pulse in response to such movement. The reference time zone circuit 9 which determines the reference time zone has programming switches 901 for producing a signal of five bits.

The timer circuit 8 generates a pulse having a time width of 5 – 10 seconds as shown in FIG. 3(e) in response to an output pulse from selection detector circuit 11. The timer circuit 8 controls the group 301 of gates in the adding control circuit 3 so that time zone selection data is provided at the outputs of OR gates 302 when the time output is a high level and the reference time zone signal is provided at the outputs of OR gates 302 when the output is a low level the outputs from OR gates 302 are applied to the duo-decimal adder circuit 4.

The display circuit 7 is provided with a display part 701 which comprises a clock display portion formed by a numeric indicator of 7 segments, a display portion for a day of the week, an AM-PM display portion, and a group of drive transistors 702.

The following description is intended to explain the operation of the device as constructed above.

For example, if the reference of the position code is taken to be at Greenwich (the longitude 0°), since Japan is located at a position of 135° of east longitude, the programming switches 901 of the region determining circuit 9 are set to the position "10010". In this condition, the time displayed by the display circuit 7 is adapted to set Japanese time by operating a time adjusting switch 202 of the clock circuit 2. At this time, the time information of the clock circuit 2 will become the Greenwich time.

In the above operation, output pulses from oscillator circuit 1 are counted in the integrated circuit 201 of the clock circuit 2 which provides time data having units of one minute, ten minutes and one hour. This data is provided at the outputs of clock circuit 201 by time multiplexing in accordance with the timing pulses $M_1$, $M_{10}$ and $H_1$ as shown in FIGS. 3(a)–(c). The time data having the units of one minutes and ten minutes are applied to the clock decoder 6 without being changed by the duo-decimal adder circuit 4. This time data is applied to the display circuit 7 after being decoded in the clock decoder 6 and is indicated on the display part 701 by turning on drive transistors 702 in accordance with the timing pulses $M_1$ and $M_{10}$.

The remaining time data having the units of hour is applied to the clock decoder 6 after correction of time difference, that is, after the duo-decimal addition with a reference time zone signal from reference time zone circuit 9 selected by gates 301 in the adding control circuit 3 in response to the high level of the timing pulse $H_1$, and the corrected time is displayed by the display circuit 7. In case the hours data is 10 or greater, the indication of the tens digit is realized by turning "ON" the corresponding transistor of the display circuit 7 by the output of the integrated circuit 402.

In this case, in the binary and hepta adder circuit 5, a binary operation is taken among the output of the D-type flip-flop 204 in the clock circuit 2, that is, the AM-PM discrimination signal, the carry signal of the duo-decimal adder circuit 4 and a portion of the output of the reference time zone circuit 9 selected by the adding control circuit 3; and according to the result of the binary operation, the indicator of "AM" or "PM" is obtained on the display circuit 7. The output of the D-type of flip-flop 204 is also applied to the hepta counter circuit 12 and is also applied to the binary and hepta adder circuit 5 after being counted in the hepta counter circuit 12. The correction of a day of the week is effected in the hepta adder portion which receives the carry signal from the binary adder portion. This signal is decoded in the decoder 13 for a day of the week and is indicated on the display part 701 of the display circuit 7.

The operation of the above embodiment has been described in terms of Japanese time. To determine time at any region other than Japan, the time zone selection is made, for example, by rotating a terrestrial globe or by displacing an operating button, the movement is detected by the selection detector circuit 11 which produces a pulse, and the pulse is fed to the timer circuit 8. In response a pulse is generated by the timer circuit 8 having a duration of 5 – 10 seconds as shown in FIG. 3(e), which causes the outputs from the reference time zone circuit 9 to be replaced by gates 301 and 302 with the outputs from the time zone selection circuit 10 which are applied to the duo-decimal adder circuit 4 and are duo-decimal adder with the time information from the clock circuit 2, the time of the selecting region being indicated on the display circuit 7. In this case, the correction is performed in the same manner as the above description.

Although the above embodiment is provided with the indication of a day of the week, the clock device may select only the clock indication.

What is claimed is:

1. A clock device comprising:

clock means for generating clock signals representative of time;

means for selecting a selected time zone;

a time zone selection circuit for providing signals representative of the selected time zone;

a reference time zone circuit for providing signals representative of a reference time zone;

detector means for detecting the selecting of a time zone and for producing an output signal in response thereto;

timer means responsive to the output signal from the detector means for producing an output signal pulse of a predetermined duration;

control means responsive to the output signal from the timer means for selecting between the signals from the time zone selection circuit and the signals from the reference time zone circuit;

adder means for adding the clock signals and the signals selected by the control means selectively to selectively produce output signals representative of correct time in the selected time zone and the reference time zone, in accordance with the output signal from the timer means; and display means responsive to said adder means output signal for displaying the correct time.

2. The clock device of claim 1 wherein said means for selecting includes a code plate.

3. The clock device of claim 2 wherein said time zone selection circuit further includes a plurality of luminescent elements and a similar plurality of photodetectors each for receiving illumination from a respective luminescent element; and wherein said code plate includes a plurality of light transmissive areas arranged so as to selectively allow illumination from said luminescent elements to impinge upon said photodetectors so as to provide an indication of the code plate division.

4. The clock device of claim 1 wherein said reference time zone circuit includes a plurality of programming switches for selection of a desired time zone.

* * * * *

UNITED STATES PATENT AND TRADEMARK OFFICE

CERTIFICATE OF CORRECTION

PATENT NO. : 4,072,005

DATED : February 7, 1978

INVENTOR(S) : Toru Teshima, Takuhisa Ehara, Kaname Nakanishi

It is certified that error appears in the above-identified patent and that said Letters Patent are hereby corrected as shown below:

Column 2, line 33, "whch" should read --which--; and
line 36, "selectio" should read --selection--.
Column 3, line 7, "detects on" should read --detects characters on--;
line 46, "one minutes" should read --one minute--; and
line 53, "hour" should read --hours--.
Column 4, line 27, "adder" should read --added--.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*